US009078510B2

(12) United States Patent
Liao

(10) Patent No.: US 9,078,510 B2
(45) Date of Patent: Jul. 14, 2015

(54) EASILY TAKEN AND CARRIED HOLDER FOR BOOTS

(71) Applicant: Yu-Wen Liao, Kaohsiung (TW)

(72) Inventor: Yu-Wen Liao, Kaohsiung (TW)

( * ) Notice: Subject to any disclaimer, the term of this patent is extended or adjusted under 35 U.S.C. 154(b) by 0 days.

(21) Appl. No.: 14/476,747

(22) Filed: Sep. 4, 2014

(65) Prior Publication Data

US 2014/0367986 A1 Dec. 18, 2014

(51) Int. Cl.
*A45F 5/10* (2006.01)
*F16M 13/06* (2006.01)

(52) U.S. Cl.
CPC ..... *A45F 5/10* (2013.01)

(58) Field of Classification Search
USPC ..... 294/65.5, 165, 15, 99.1, 137, 142, 152, 294/156, 158, 159; 36/1, 112, 136; 24/301, 24/302, 303
See application file for complete search history.

(56) References Cited

U.S. PATENT DOCUMENTS 3,041,743 A * 7/1962 Monsma ..... 36/1
3,529,328 A * 9/1970 Davison ..... 24/303
4,465,993 A * 8/1984 Braillon ..... 294/65.5
4,624,060 A * 11/1986 Maxwell ..... 36/1
4,867,359 A * 9/1989 Donovan ..... 224/602
5,067,618 A * 11/1991 Johnson ..... 211/85.3
5,269,690 A * 12/1993 Zigon ..... 434/258
5,682,653 A * 11/1997 Berglof et al. ..... 24/303
5,785,223 A * 7/1998 Matsushita ..... 224/609
6,003,212 A * 12/1999 Imahata ..... 36/1
6,092,241 A * 7/2000 Bellet ..... 2/239
6,182,382 B1 * 2/2001 Skinner ..... 36/136
7,895,774 B2 * 3/2011 Pawsey ..... 36/136
2013/0048827 A1 * 2/2013 Meier et al. ..... 248/682

* cited by examiner

*Primary Examiner* — Paul T Chin

(57) ABSTRACT

An easily taken and carried holder for boots is provided with a flexible handle and two holding assemblies secured to both ends of the flexible handle respectively. Each of the holding assemblies comprises an internal space and a magnet in the space. The magnet has two poles so that the magnets of the holding assemblies can attract each other to bring the boots into contact when the holding assembles are inserted into the boots. The flexible handle can be used to take and suspend the boots. The ferromagnetic members can kept the boots upright and prevent the boots from falling to cause wrinkles when the ferromagnetic members are inserted into the boots to be attracted by the magnets. The invention has characteristics of easy taking, secure hold, practicability, and convenient storage.

1 Claim, 3 Drawing Sheets

EASILY TAKEN AND CARRIED HOLDER FOR BOOTS

BACKGROUND OF THE INVENTION

1. Field of the Invention

The invention relates to holders and more particularly to an easily taken and carried holder for holding a pair of boots in place so as to have characteristics of easy taking, secure hold, practicability, and convenient storage.

2. Description of Related Art

Wearing boots are becoming popular as life quality improves. After taking off boots, a wearer may insert a hard object into each boot so as to prevent the boots from being slack. Otherwise, surfaces of the boots may wrinkle and the boots may be visually unattractive.

Conventionally, a holder for one of a pair of shoes is a hard object adapted to dispose in the shoe. The hard object is shaped to comply with the shape of the shoe. However, it is not for boots having a protective covering for part of the leg. It is also known that upper portions of boots may bend when the boots are not used and if portions of the boots covering part of the legs are not made of rigid materials. Disadvantageously, the boots may have a shortened useful life and are not easy to remove out of the holders.

The present inventor is aware that the invention is neither taught nor rendered obvious thereby.

SUMMARY OF THE INVENTION

It is therefore one object of the invention to provide an easily taken and carried holder for holding a pair of boots in place so as to have characteristics of easy taking, secure hold, practicability, and convenient storage.

In one aspect of the invention, an easily taken and carried holder for a pair of boots comprising a flexible handle; and two holding assemblies secured to both ends of the flexible handle respectively; wherein each of the holding assemblies comprises an internal space and a magnet disposed in the internal space; wherein a north pole of the magnet of one holding assembly faces a south pole of the magnet of an other holding assembly, and a south pole of the magnet of one holding assembly faces a north pole of the magnet of the other holding assembly so that the magnets of the holding assemblies can attract each other to bring the boots into contact; and wherein there are further provided two ferromagnetic members each being capable of being attracted by the magnet of one of the holding assemblies so that the boot can be kept upright when the ferromagnetic members are inserted into the boots.

By utilizing the easily taken and carried holder for boots of the invention, when the holding assemblies are disposed in upper portions of the boots after a user taking off the boots, the magnet of one holding assembly attracts the magnet of the other holding assembly to bring the boots into contact; the flexible handle can be used to take and suspend the boots; the ferromagnetic members can kept the boots upright and prevent the boots from falling to cause wrinkles when the ferromagnetic members are inserted into the boots; and thus the invention has characteristics of easy taking, secure hold, practicability, and convenient storage.

The above and other objects, features and advantages of the invention will become apparent from the following detailed description taken with the accompanying drawings.

DETAILED DESCRIPTION OF THE INVENTION

Figure 1:
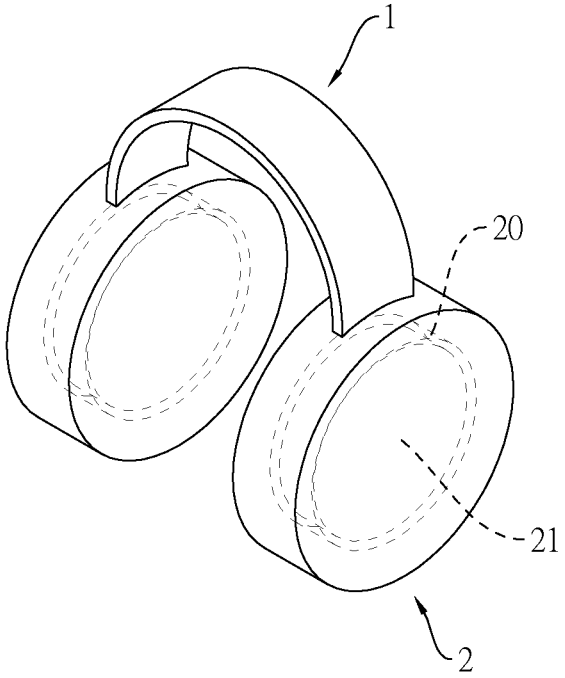
FIG. 1 is a perspective view of an easily taken and carried holder for boots according to a first preferred embodiment of the invention.
Figure 2:
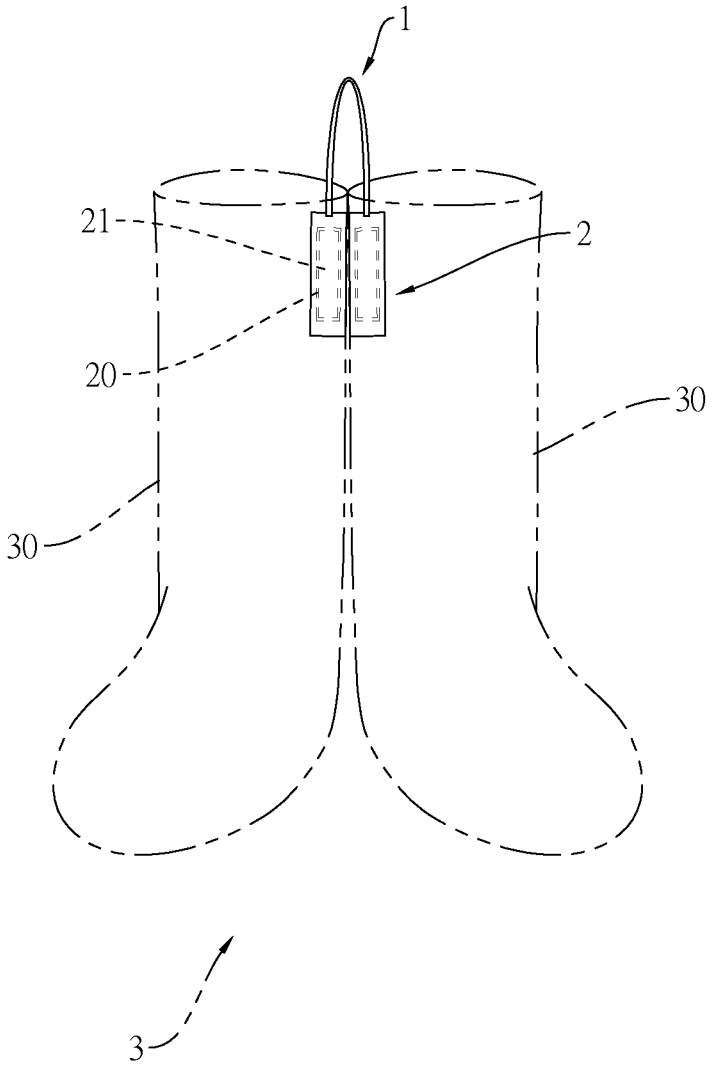
FIG. 2 shows a pair of boots held together by the holder.

Referring to FIGS. 1 and 2, an easily taken and carried holder for boots in accordance with a first preferred embodiment of the invention comprises a flexible handle 1 and two holding assemblies 2 secured to both ends of the handle 1 respectively. The holding assembly 2 comprises an internal space 20 and a magnet 21 disposed in the space 20.

In view of above, a north pole of the magnet 21 of one holding assembly 2 faces a south pole of the magnet 21 of an other holding assembly 2, and a south pole of the magnet 21 thereof faces a north pole of the magnet 21 of an other holding assembly 2 when the invention is used with the holding assemblies 2 disposed in upper portions 30 of a pair of boots 3 after a user taking off the boots 3. Thus, the north pole of the magnet 21 of one holding assembly 2 attracts the south pole of the magnet 21 of an other holding assembly 2, and the south pole of the magnet 21 thereof attracts the north pole of the magnet 21 of an other holding assembly 2 when the holding assemblies 2 are in close proximity on the upper portions 30 of the boots 3. As such, the upper portions 30 of the boots 3 are kept upright. The user may use the flexible handle 1 to take and hold the boots 3 made of soft material in place. Therefore, a user may easily take and carry the boots 3 in home or at an outdoor environment.

Figure 3:
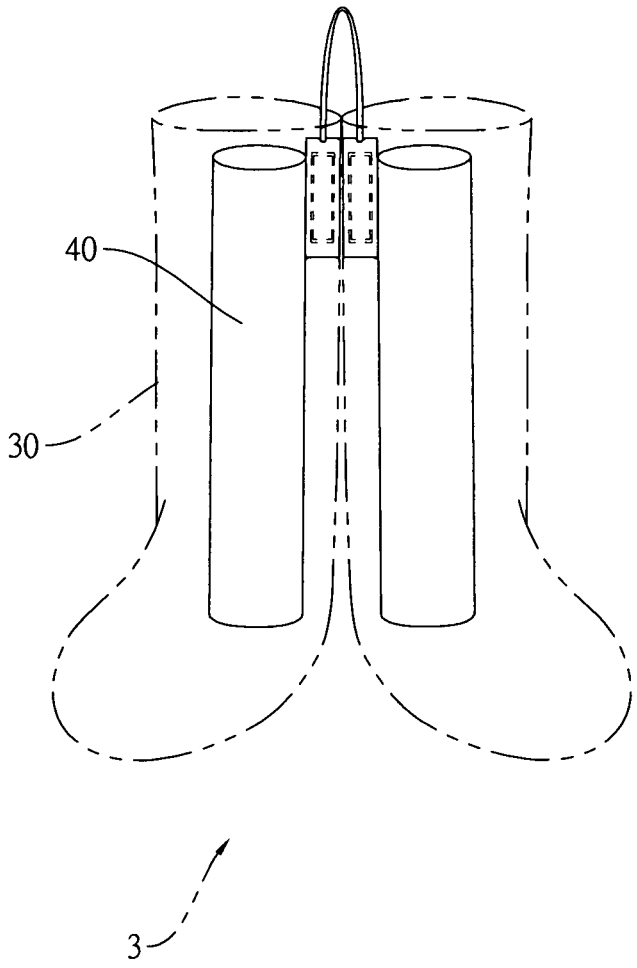
FIG. 3 is a perspective view of an easily taken and carried holder for boots according to a second preferred embodiment of the invention.

Referring to FIG. 3 in conjunction with FIG. 1, an easily taken and carried holder for boots in accordance with a second preferred embodiment of the invention is shown. The characteristics of the second preferred embodiment are substantially the same as that of the first preferred embodiment except the following: Two cylindrical ferromagnetic members 40 are adapted to insert into the upper portions 30 of the boots 3 wherein the ferromagnetic members 40 are attracted by the magnets 21 of the holding assemblies 2. The ferromagnetic members 40 are inserted into the flexible upper portions 30 of the boots 3 to keep it upright. Otherwise, the upper portions 30 of the boots 3 may fall. Further, a user may not worry that the upper portions 30 of the boots 30 may wrinkle due to the falling of the upper portions 30. In use, a user may remove the ferromagnetic members 40 out of the boots 3 and remove the holding assemblies 2 out of the boots 3. Thus, the attracting force of the holding assemblies 2 are eliminated. The holding assemblies 2 attract each other after removing out of the boots 3. Therefore, the invention can be stored in a handbag or used a suspended decoration of a handbag. Thus, the invention has characteristics of easy taking, reliable hold, practicability, and convenient storage.

In view of above description, the easily taken and carried holder for boots of the invention has the following advantages:

The improved easily taken and carried holder for boots of the invention utilizes the holding assemblies to bring a pair of boots into contact and keep the boots upright.

The improved easily taken and carried holder for boots of the invention allows a user to use the flexible handle to take and hold the boots made of soft material in place. Therefore, the boots can be kept upright without being fallen to cause wrinkles.

The improved easily taken and carried holder for boots of the invention is characterized by easy taking, reliable hold, practicability, and convenient storage.

While the invention has been described in terms of preferred embodiments, those skilled in the art will recognize that the invention can be practiced with modifications within the spirit and scope of the appended claims.

What is claimed is:

1. An easily taken and carried holder for a pair of boots comprising:

a flexible handle;

two holding assemblies secured to both ends of the flexible handle respectively; and two ferromagnetic members adjacent to the holding assemblies respectively;

wherein each of the ferromagnetic members is attracted by the magnet of one of the holding assemblies to make the boots upright;

wherein each of the holding assemblies comprises an internal space and a magnet disposed in the internal space; and wherein a north pole of the magnet of one holding assembly faces a south pole of the magnet of an other holding assembly, and a south pole of the magnet of one holding assembly faces a north pole of the magnet of the other holding assembly so that the magnets of the holding assemblies can attract each other to bring the boots into contact.

* * * * *